US009694299B1

(12) United States Patent
Kouso

(10) Patent No.: US 9,694,299 B1
(45) Date of Patent: Jul. 4, 2017

(54) BUBBLE BLOWING ASSEMBLY

(71) Applicant: Sam Kouso, Melbourne (AU)

(72) Inventor: Sam Kouso, Melbourne (AU)

( * ) Notice: Subject to any disclaimer, the term of this patent is extended or adjusted under 35 U.S.C. 154(b) by 674 days.

(21) Appl. No.: 14/146,523

(22) Filed: Jan. 2, 2014

(51) Int. Cl.
*A63H 33/28* (2006.01)
*F04B 9/14* (2006.01)

(52) U.S. Cl.
CPC ..... *A63H 33/28* (2013.01); *F04B 9/14* (2013.01)

(58) Field of Classification Search
USPC ..... 446/15–21, 483, 475
See application file for complete search history.

(56) References Cited

U.S. PATENT DOCUMENTS 612,121 A * 10/1898 Rakovsky ..... A63H 33/28 446/21
1,206,727 A * 11/1916 Parker ..... F41B 9/004 222/214
1,733,478 A * 10/1929 Warham ..... A63H 33/28 40/408
1,880,354 A * 10/1932 Mueller ..... F41B 9/0009 124/71
2,249,608 A * 7/1941 Greene ..... F41B 9/0015 222/399
2,393,039 A * 1/1946 Gilchrist, Jr. ..... A63H 33/28 446/17
2,518,627 A * 8/1950 Lorenz ..... A63H 33/28 224/148.5
2,553,388 A * 5/1951 Steiner ..... A63H 33/28 124/37
2,560,582 A * 7/1951 Limber ..... A63H 33/28 446/18
2,587,535 A * 2/1952 Scott ..... A63H 33/28 124/55
2,587,536 A * 2/1952 Scott ..... A63H 33/28 446/18
2,587,537 A * 2/1952 Scott ..... A63H 33/28 446/18
2,599,888 A * 6/1952 Beezley ..... A63H 33/28 124/55
2,606,396 A * 8/1952 Hill ..... A63H 33/28 239/355
2,659,177 A * 11/1953 Kopf ..... A63H 33/28 124/67
2,700,845 A * 2/1955 Arliss ..... A63H 33/28 124/55

(Continued)

*Primary Examiner* — Gene Kim
*Assistant Examiner* — Matthew B Stanczak

(57) ABSTRACT

A bubble blowing assembly for blowing bubbles with manually pumped air includes a tubular housing that may be gripped by a user. A pump is operationally coupled to the tubular housing. The pump urges air into the tubular housing. A primary reservoir is operationally coupled to the tubular housing. The primary reservoir may contain a fluid. A nozzle is operationally coupled to the tubular housing. A fluid hose is operationally coupled between the tubular housing and the primary reservoir. The fluid hose selectively directs the fluid into the nozzle. A first air hose is operationally coupled between the tubular housing and the nozzle. The first air hose directs the pumped air into the nozzle. The nozzle generates the bubbles when the user pumps the pump. A secondary reservoir is coupled to the tubular housing. The secondary reservoir collects excess fluid from the nozzle.

16 Claims, 5 Drawing Sheets

(56) References Cited

U.S. PATENT DOCUMENTS 2,802,298 A * 8/1957 Larin ..... A63H 33/28 124/1
2,828,579 A * 4/1958 Schwerbel ..... A63H 33/28 124/55
2,974,438 A * 3/1961 Hopkins ..... A63H 33/28 446/16
3,093,925 A * 6/1963 Greene ..... A63H 33/28 446/18
3,142,200 A * 7/1964 Stillman ..... F41B 9/004 124/55
3,389,492 A * 6/1968 Sullivan ..... F41B 9/004 446/21
3,398,479 A * 8/1968 Rave ..... A63H 33/28 446/21
3,399,485 A * 9/1968 Cashavelly ..... F41B 9/004 124/55
3,575,318 A * 4/1971 Kunz ..... B05B 11/048 222/326
3,636,652 A * 1/1972 Dumont ..... A63H 33/28 446/15
3,733,736 A * 5/1973 Glessner, Sr. ..... A63H 33/28 446/18
3,736,694 A * 6/1973 Lebensfeld ..... A63H 33/28 446/16
3,834,066 A * 9/1974 Vargas ..... A63H 33/28 446/21
3,925,923 A * 12/1975 La Fata ..... A63H 33/28 446/18
4,166,084 A 8/1979 Shea
4,276,713 A * 7/1981 Crosbie ..... A63H 33/28 446/21
4,334,383 A * 6/1982 Melotti ..... A63H 33/28 222/79
5,042,819 A * 8/1991 LaFata ..... A63H 33/28 273/349
5,205,771 A * 4/1993 Sims ..... A63H 33/28 446/197
D338,505 S 8/1993 LaFata
5,498,191 A * 3/1996 DeMars ..... A63H 33/28 446/15
5,655,890 A 8/1997 Liao
5,799,827 A * 9/1998 D'Andrade ..... B05B 1/34 222/212
5,975,358 A * 11/1999 Zheng ..... F41B 9/0018 222/79
6,138,871 A * 10/2000 D'Andrade ..... F41B 9/0018 141/18
6,203,397 B1 * 3/2001 Applewhite ..... F41B 9/0018 446/15
2004/0142626 A1 * 7/2004 Choi ..... A63H 33/28 446/15
2004/0259458 A1 * 12/2004 Fusco ..... A63H 33/28 446/15
2009/0124161 A1 5/2009 Barish
2012/0270462 A1 * 10/2012 Lo ..... A63H 33/28 446/15
2014/0141688 A1 * 5/2014 Kelly ..... A63H 33/28 446/15

* cited by examiner

BUBBLE BLOWING ASSEMBLY

BACKGROUND OF THE DISCLOSURE

Field of the Disclosure

The disclosure relates to bubble blowing devices and more particularly pertains to a new bubble blowing device for blowing bubbles with manually pumped air.

SUMMARY OF THE DISCLOSURE

An embodiment of the disclosure meets the needs presented above by generally comprising a tubular housing that may be gripped by a user. A pump is operationally coupled to the tubular housing. The pump may be pumped by the user so the pump urges air into the tubular housing. A primary reservoir is operationally coupled to the tubular housing. The primary reservoir may contain a fluid. A nozzle is operationally coupled to the tubular housing. A fluid hose is operationally coupled between the tubular housing and the primary reservoir. The fluid hose selectively directs the fluid into the nozzle. A first air hose is operationally coupled between the tubular housing and the nozzle. The first air hose directs the pumped air into the nozzle. The nozzle generates the bubbles when the user pumps the pump. A secondary reservoir is coupled to the tubular housing. The secondary reservoir collects excess fluid from the nozzle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
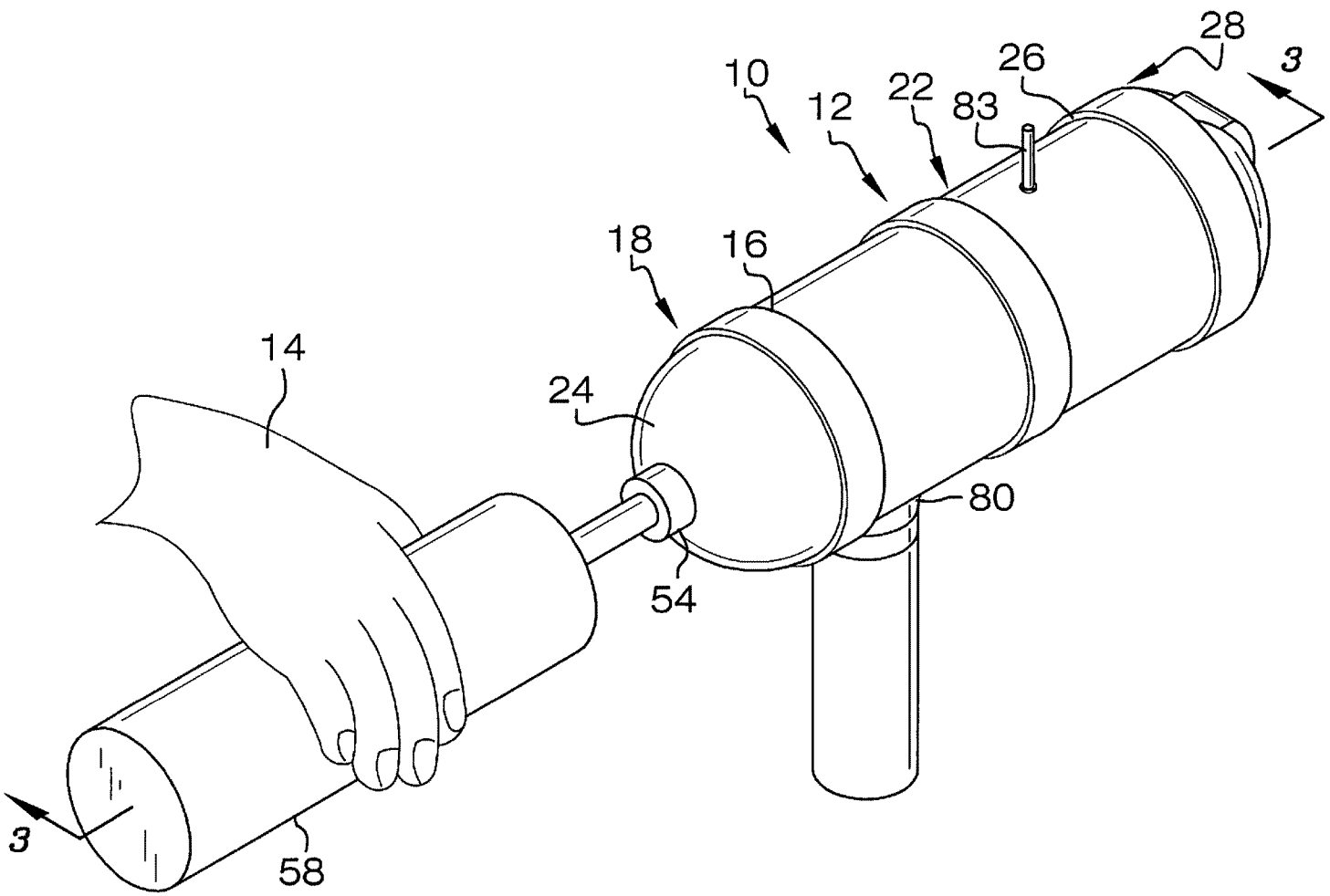
FIG. 1 is a perspective view of a bubble blowing assembly according to an embodiment of the disclosure.
Figure 2:
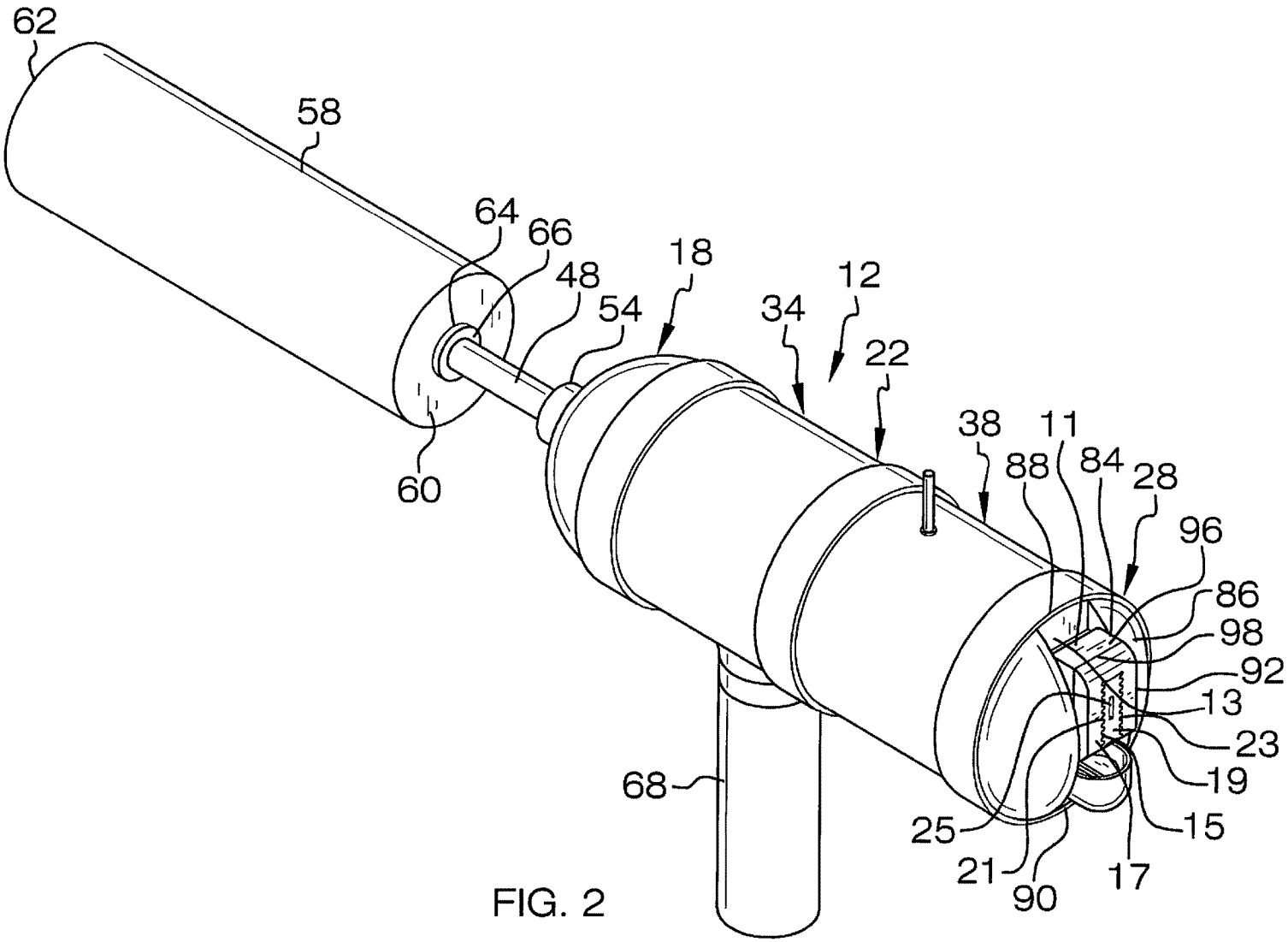
FIG. 2 is a front perspective view of an embodiment of the disclosure.
Figure 3:
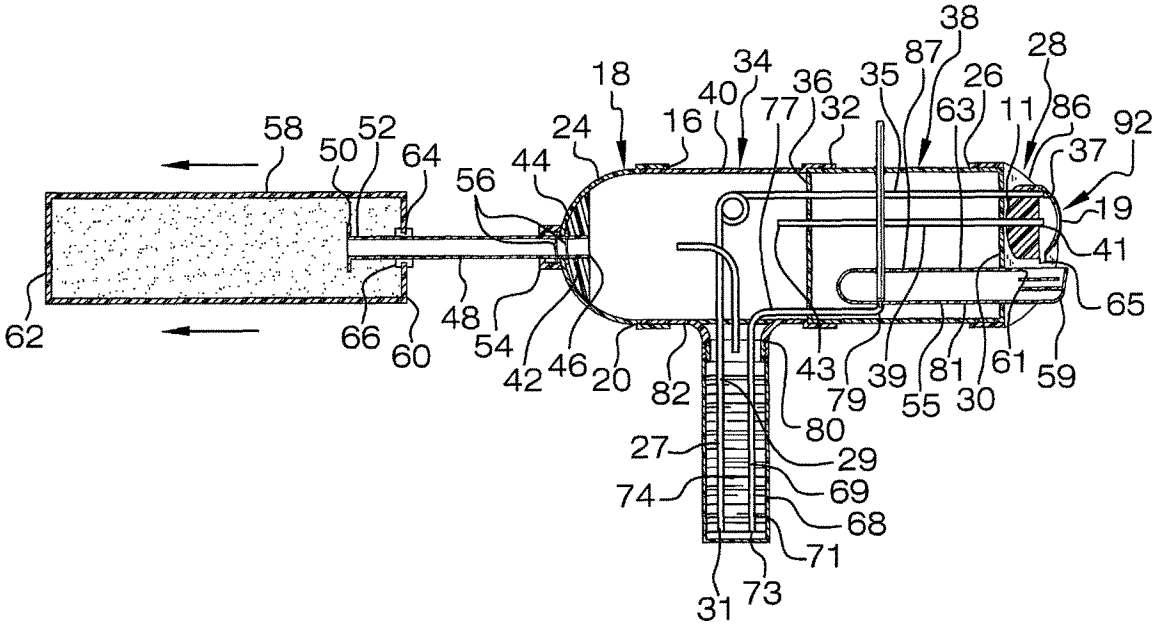
FIG. 3 is a cross sectional view of an embodiment of the disclosure taken along line 3-3 of FIG. 1.
Figure 4:
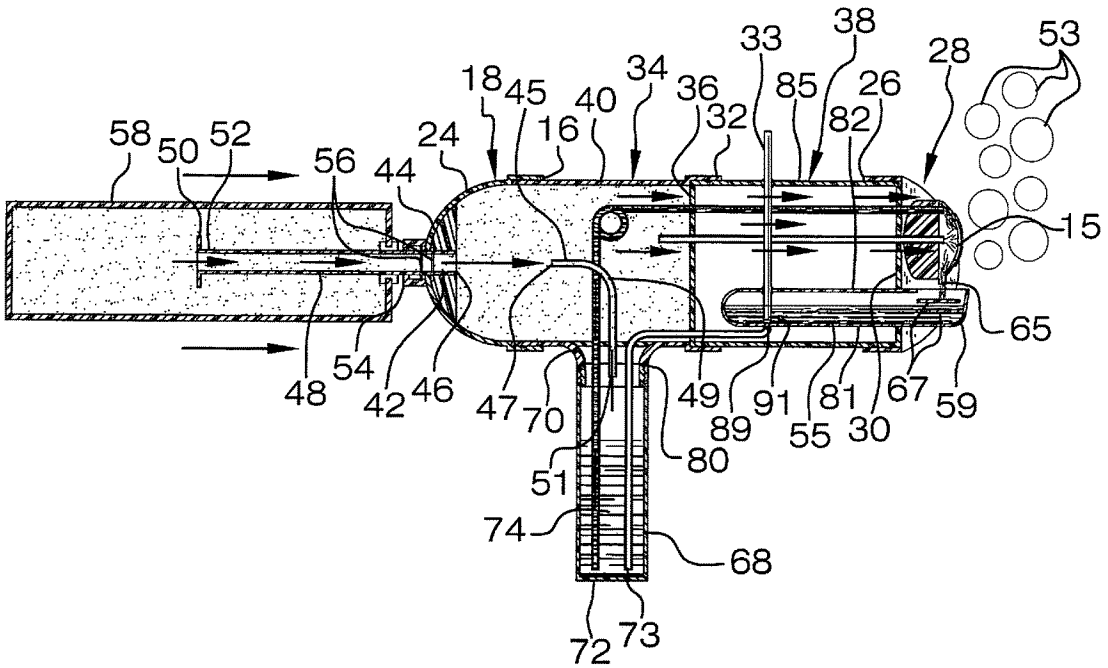
FIG. 4 is an alternate cross sectional view of an embodiment of the disclosure taken along line 3-3 of FIG. 1.
Figure 5:
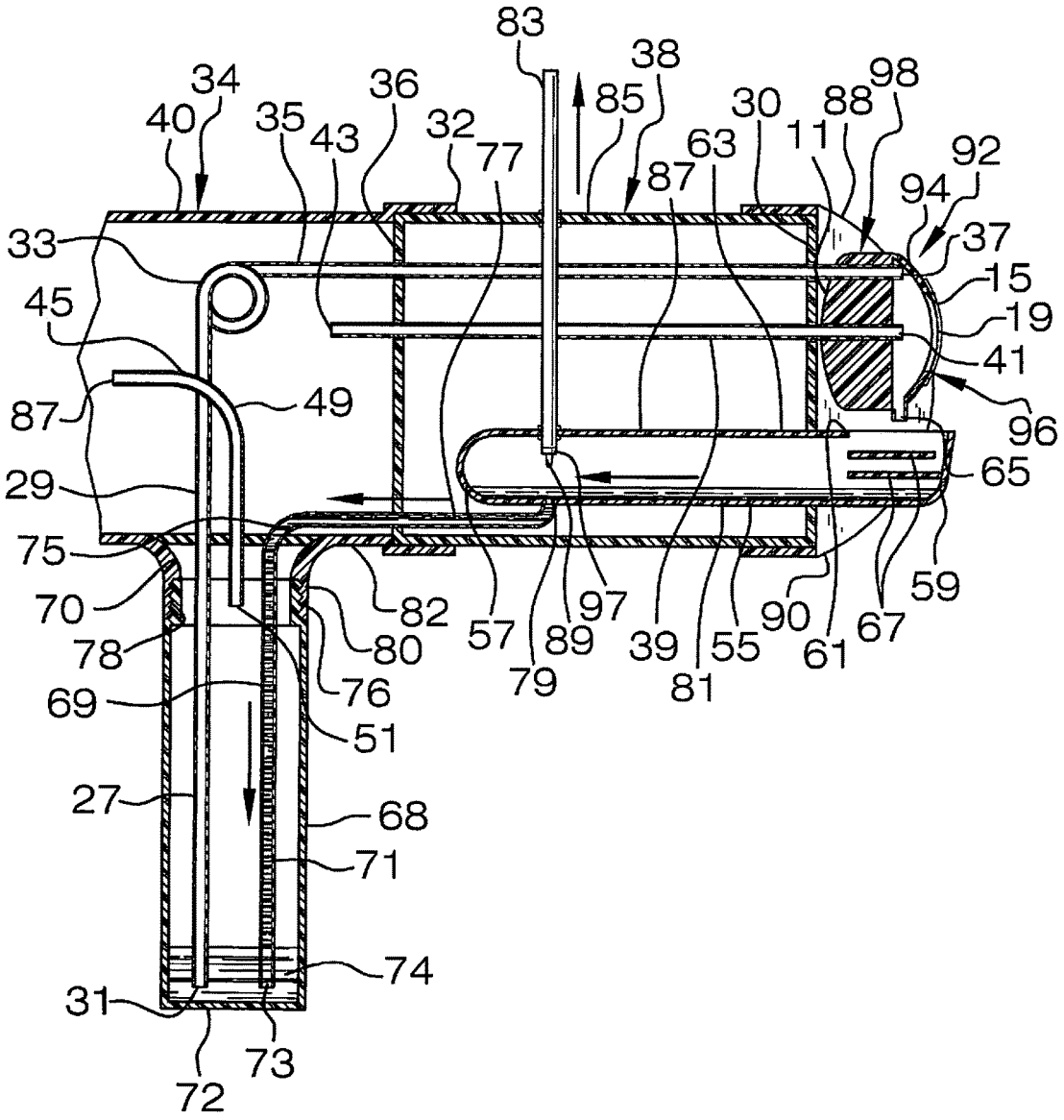
FIG. 5 is a cut away view of an embodiment of the disclosure.

With reference now to the drawings, and in particular to FIGS. 1 through 5 thereof, a new bubble blowing device embodying the principles and concepts of an embodiment of the disclosure and generally designated by the reference numeral 10 will be described.

As best illustrated in FIGS. 1 through 5, the bubble blowing assembly 10 generally comprises a tubular housing 12 that may be gripped by a user 14. The tubular housing 12 may have a length between 15 cm and 25 cm and a diameter between 7 cm and 10 cm. An open front end 16 of a semi-hemispherical rear portion 18 of the tubular housing 12 is removably coupled to an open rear end 20 of a cylindrical central portion 22 of the tubular housing 12. The open front end 16 of the semi-hemispherical rear portion 18 of the tubular housing 12 has an inside diameter that is greater than an inside diameter of a body 24 of the semi-hemispherical rear portion 18 of the tubular housing 12. Continuing, an open rear end 26 of a semi-hemispherical front portion 28 of the tubular housing 12 is removably coupled to a closed front end 30 of the cylindrical central portion 22 of the tubular housing 12.

The cylindrical central portion 22 of the tubular housing 12 is one of a pair of the cylindrical central portions 22 of the tubular housing 12. An open front end 32 of a rear one of the pair of cylindrical central portions 34 of the tubular housing 12 is coupled to a closed rear end 36 of a front one of the pair of cylindrical central portions 38 of the tubular housing 12. Continuing, an interior of the rear cylindrical central portion 34 of the tubular housing 12 is discrete from an interior of the front cylindrical central portion 38 of the tubular housing 12. The open front end 32 of the rear cylindrical central portion 34 of the tubular housing 12 has an inside diameter that is greater than an inside diameter of a body 40 of the rear cylindrical central portion 34 of the tubular housing 12.

A first air pipe aperture 42 extends through a rear end 44 of the semi-hemispherical rear portion 18 of the tubular housing 12. Additionally, a first end 46 of an air pipe 48 extends through the first air aperture 42. The air pipe 48 is in fluid communication with an interior of the rear cylindrical central portion 34 of the tubular housing 12. Additionally, the air pipe 48 may have a length between 22 cm and 30 cm. A stop 50 is coupled to a second end 52 of the air pipe 48.

A nipple 54 is coupled to and extends rearwardly away from the rear end 44 of the semi-hemispherical rear portion 18 of the tubular housing 12. The nipple 54 is aligned with the first air pipe aperture 42. Additionally, the air pipe 48 extends through the nipple 54. A pair of pins 56 extends through the air pipe 48 proximate the first end 46 of the air pipe 48. Each of the pair of pins 56 is positioned on opposite sides of the rear end 44 of the semi-hemispherical rear portion 18 of the tubular housing 12. The pair of pins 56 retains the air pipe 48 in the first air pipe aperture 42.

A pump 58 is elongated along a longitudinal axis extending through a front end 60 and a back end 62 of the pump 58. The pump 58 has a hollow cylindrical shape that may have a length between 15 cm and 25 cm and a diameter between 6 cm and 8 cm. A second air pipe aperture 64 extends through the front end 60 of the pump 58. The air pipe 48 extends through the second air pipe aperture 64. A grommet 66 is positioned within the second air pipe aperture 64 and surrounds the air pipe 48. The grommet 66 seals the second air pipe aperture 64.

The pump 58 is slidably coupled to the air pipe 48. Moreover, the air pipe 48 is in fluid communication with an interior of the pump 58. The pump 58 is selectively urged toward and away from the tubular housing 12 along the air pipe 48. Further, the front end 60 of the pump 58 abuts the stop 50 on the air pipe 48 when the pump 58 is urged away from the tubular housing 12. Additionally, the pump 58 urges air into an interior of the rear cylindrical central portion 34 of the tubular housing 12.

A primary reservoir 68 is elongated along a longitudinal axis extending through an open top end 70 and a closed bottom end 72 of the primary reservoir 68. The primary reservoir 68 has a hollow cylindrical shape that may have a length between 7 cm and 12 cm and a diameter between 2 cm and 4 cm. Moreover, the primary reservoir 68 may contain a fluid 74. The fluid 74 may be a liquid bubble solution of any conventional design. An outer surface 76 of the open top end 70 of the primary reservoir 68 threadably engages an inner surface 78 of a nipple 80 extending downwardly from a bottom side 82 of the rear cylindrical central portion 34 of the tubular housing 12. The primary reservoir 68 is selectively retained on the rear cylindrical central portion 34 of the tubular housing 12.

A channel 84 extends into a front side 86 of the semi-hemispherical front portion 28 of the tubular housing 12. The channel 84 extends between a top side 88 and a bottom side 90 of the semi-hemispherical front portion 28 of the tubular housing 12. A nozzle 92 is coupled to the tubular housing 12. An outer wall 94 of the nozzle 92 is curved so the nozzle 92 has an ovoid shape that may have a height between 4 cm and 6 cm and a width between 2 cm and 4 cm. A hollow front portion 96 of the nozzle 92 is coupled to a solid rear portion 98 of the nozzle 92. Continuing, a rear side 11 of the outer wall 94 of the nozzle 92 is coupled to a back wall 13 of the channel 84.

The hollow front portion 96 of the nozzle 92 is directed forwardly from the semi-hemispherical front portion 28 of the tubular housing 12. A bubble opening 15 extends through a front side 17 of the hollow front portion 96 of the nozzle 92. Additionally, a film 19 is coupled to the hollow front portion 96 of the nozzle 92 so the film 19 covers the bubble opening 15. Each of a first lateral side 21 and a second lateral side 23 of the film 19 has a zig-zag shape. A rectangular bubble aperture 25 extends through the film 19.

A lower portion 27 of a fluid hose 29 extends downwardly through the nipple 80 on the rear cylindrical central portion 34 of the tubular housing 12. Further, a bottom end 31 of the fluid hose 29 is positioned proximate the closed bottom end 72 of the primary reservoir 68. A pig tail portion 33 of the fluid hose 29 directs an upper portion 35 of the fluid hose 29 forwardly through tubular housing 12. The upper portion 35 of the fluid hose 29 extends through each of the closed rear end 36 and the closed front end 30 of the front cylindrical center portion 38 of the tubular housing 12 and the solid rear portion 98 of the nozzle 92. A front end 37 of the fluid hose 29 is positioned within an interior of the hollow front portion 96 of the nozzle 92. Each of the lower 27 and upper 35 portions of the fluid hose 29 may have a length between 12 cm and 14 cm.

A first air hose 39 extends through each of the closed rear end 36 and the closed front end 30 of the front cylindrical center portion 38 of the tubular housing 12 and the solid rear portion 98 of the nozzle 92. Moreover, a front end 41 of the first air hose 39 is positioned within an interior of the hollow front portion 96 of the nozzle 92. A rear end 43 of the first air hose 39 is positioned within an interior of the rear cylindrical center portion 34 of the tubular housing 12. The first air hose 39 may have a length between 10 cm and 14 cm. The pump 58 selectively urges air through the first air hose 39 so the air is delivered into the hollow front portion 96 of the nozzle 92.

A second air hose 45 is coupled to the tubular housing 12. Continuing, a first end 47 of the second air hose 45 is positioned within an interior of the rear cylindrical center portion 34 of the tubular housing 12. A central bend 49 on the second air hose 45 directs a second end 51 of the second air hose 45 downwardly into the nipple 80 on the rear cylindrical center portion 34 of the tubular housing 12. The second air hose 45 may have a length between 4 cm and 6 cm.

The second air hose 45 places the primary reservoir 68 in fluid communication with an interior of the rear cylindrical central portion 34 of the tubular housing 12. Continuing, the pump 58 selectively urges air into the primary reservoir 68. The fluid 74 in the primary reservoir 68 is urged upwardly through the fluid hose 29 so the fluid 74 is delivered into the hollow front portion 96 of the nozzle 92. The fluid 74 mixes with the air in the nozzle 92 to create bubbles 53 when the user 14 moves the pump 58. Lastly, the bubbles 53 exit the rectangular bubble aperture 25 in the film 19.

A secondary reservoir 55 is coupled to the tubular housing 12. A rear end 57 of the secondary reservoir 55 is positioned within an interior of the front cylindrical center portion 38 of the tubular housing 12. Moreover, the secondary reservoir 55 extends forwardly through the back wall 13 of the channel 84. A front end 59 of the secondary reservoir 55 is positioned beneath the nozzle 92. Lastly, the secondary reservoir 55 may have a length between 7 cm and 12 cm.

An opening 61 extends through a top side 63 of the secondary reservoir 55 proximate the front end 59 of the secondary reservoir 55. The opening 61 is positioned below a drain 65 in the nozzle 92. The secondary reservoir 55 receives excess fluid 74 from the drain 65. A pair of plates 67 is coupled to the secondary reservoir 55. Each of the pair of plates 67 is positioned proximate the opening 61 in the secondary reservoir 55.

A liquid return hose 69 is coupled to the tubular housing 12. A lower portion 71 of the liquid return hose 69 extends downwardly through the nipple 80 in the rear cylindrical center portion 34 of the tubular housing 12. Moreover, a bottom end 73 of the liquid return hose 69 is positioned proximate the closed bottom end 72 of the primary reservoir 68. A central bend 75 in the liquid return hose 69 directs a forward portion 77 of the liquid return hose 69 through the closed rear end 36 of the front cylindrical central portion 38 of the tubular housing 12. A front end 79 of the liquid return hose 69 is fluidly coupled to a bottom side 81 of the secondary reservoir 55. Lastly, the liquid return hose 69 may have a length between 15 cm and 20 cm.

A release rod 83 extends downwardly through a top side 85 of the front cylindrical central portion 34 of the tubular housing proximate the closed rear end 36 of the front cylindrical central portion 34 of the tubular housing 12. Additionally, the release rod 83 extends downwardly through a top side 87 of the secondary reservoir 55. The release rod 83 may have a length between 10 cm and 15 cm. A nipple 89 is coupled a bottom end 91 of the release rod 83. The nipple 89 is positioned within the front end 79 of the liquid return hose 69 so the nipple 89 closes the front end 79 of the liquid return hose 69. The release rod 83 is selectively urged upwardly so the nipple 89 is removed from the front end 79 of the liquid return hose 69. Further, the liquid 74 in the secondary reservoir 55 travels through the liquid return hose 69 into the primary reservoir 68.

In use, the primary reservoir 68 is removed from the rear cylindrical central portion 34 of the tubular housing 12 and is filled with the fluid 74. Continuing, the primary reservoir 68 is coupled to the rear cylindrical central portion 34 of the tubular housing 12. The user 14 urges the pump 58 forwardly and rearwardly on the air pipe 48. Continuing, the user 14 varies the speed with which the pump 28 is moved along the air pipe 48 to alter a size of the bubbles 53. A slower speed results in a smaller number of larger bubbles 53. Additionally, a faster speed results in a larger number of smaller bubbles 53.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump, said first air hose extending through each of a closed rear end and a closed front end of a front cylindrical center portion of said tubular housing and a solid rear portion of said nozzle, a front end of said first air hose being positioned within an interior of a hollow front portion of said nozzle and a rear end of said first air hose is positioned within an interior of a rear cylindrical center portion of said tubular housing, wherein said pump selectively urges air through said first air hose wherein the air is delivered into said hollow front portion of said nozzle; and a secondary reservoir coupled to said tubular housing wherein said secondary reservoir collects excess fluid from said nozzle.

2. The assembly according to claim 1 further comprising:

a first air pipe aperture extending through a rear end of a semi-hemispherical rear portion of said tubular housing; and a first end of an air pipe extending through said first air aperture wherein said air pipe is in fluid communication with an interior of a rear cylindrical central portion of said tubular housing.

3. The assembly according to claim 2 further comprising:

a second air pipe aperture extending through a front end of said pump;

an air pipe extending through said second air pipe aperture wherein said pump is slidably coupled to said air pipe wherein said air pipe is in fluid communication with an interior of said pump; and wherein said pump being selectively urged toward and away from said tubular housing along said air pipe wherein said pump urges air into an interior of said rear cylindrical central portion of said tubular housing.

4. The assembly according to claim 1 further comprising said pump being elongated along a longitudinal axis extending through a front end and a back end of said pump wherein said pump has a hollow cylindrical shape.

5. The assembly according to claim 1 further comprising said primary reservoir being elongated along a longitudinal axis extending through an open top end and a closed bottom end of said primary reservoir wherein said primary reservoir has a hollow cylindrical shape.

6. The assembly according to claim 1 further comprising an outer surface of an open top end of said primary reservoir threadably engaging an inner surface of a nipple extending downwardly from a bottom side of a rear cylindrical central portion of said tubular housing wherein said primary reservoir is selectively retained on said rear cylindrical central portion of said tubular housing.

7. The assembly according to claim 1 further comprising:

a lower portion of said fluid hose extending downwardly through a nipple wherein a bottom end of said fluid hose is positioned proximate a closed bottom end of said primary reservoir; and a pig tail portion of said fluid hose directing an upper portion of said fluid hose forwardly through each of said closed rear end and a closed front end of a front cylindrical center portion of said tubular housing and said solid rear portion of said nozzle wherein a front end of said fluid hose is positioned within said interior of said hollow front portion of said nozzle.

8. The assembly according to claim 1 further comprising:

a second air hose coupled to said tubular housing;

a first end of said second air hose being positioned within an interior of said rear cylindrical center portion of said tubular housing;

a central bend on said second air hose directing a second end of said second air hose downwardly into a nipple wherein primary reservoir is in fluid communication with an interior of said rear cylindrical central portion of said tubular housing; and said pump selectively urging air into said primary reservoir wherein the fluid in said primary reservoir is urged upwardly through said fluid hose wherein the fluid is delivered into a hollow front portion of said nozzle.

9. The assembly according to claim 1 further comprising:

wherein a rear end of said secondary reservoir is positioned within an interior of said front cylindrical center portion of said tubular housing;

wherein said secondary reservoir extending forwardly through a back wall of a channel wherein a front end of said secondary reservoir is positioned beneath said nozzle; and an opening extending through a top side of said secondary reservoir proximate said front end of said secondary reservoir wherein said opening is positioned below a drain in said nozzle wherein said secondary reservoir receives excess fluid from said drain.

10. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump; and a secondary reservoir coupled to said tubular housing wherein said secondary reservoir collects excess fluid from said nozzle;

an open front end of a semi-hemispherical rear portion of said tubular housing being removably coupled to said open rear end of a cylindrical central portion of said tubular housing;

an open rear end of a semi-hemispherical front portion of said tubular housing being removably coupled to a closed front end of a cylindrical central portion of said tubular housing;

said cylindrical central portion of said tubular housing being one of a pair of said cylindrical central portions of said tubular housing; and an open front end of a rear one of said pair of cylindrical central portions of said tubular housing being coupled to a closed rear end of a front one of said pair of cylindrical central portions of said tubular housing wherein an interior of said rear cylindrical central portion of said tubular housing is discrete from an interior of said front cylindrical central portion of said tubular housing.

11. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump; and a secondary reservoir coupled to said tubular housing wherein said secondary reservoir collects excess fluid from said nozzle;

a channel extending into a front side of a semi-hemispherical front portion of said tubular housing wherein said channel extends between a top side and a bottom side of said semi-hemispherical front portion of said tubular housing;

an outer wall of said nozzle being curved wherein said nozzle has an ovoid shape;

a hollow front portion of said nozzle being coupled to said solid rear portion of said nozzle;

a rear side of an outer wall of said nozzle being coupled to a back wall of said channel wherein said hollow front portion of said nozzle is directed forwardly from said semi-hemispherical front portion of said tubular housing;

a bubble opening extending through a front side of said hollow front portion of said nozzle; and a film coupled to said hollow front portion of said nozzle wherein said film covers said bubble opening.

12. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump; and a secondary reservoir coupled to said tubular housing wherein said secondary reservoir collects excess fluid from said nozzle;

a liquid return hose coupled to said tubular housing;

wherein a lower portion of said liquid return hose extends downwardly through said nipple wherein a bottom end of said liquid return hose is positioned proximate a closed bottom end of said primary reservoir;

a central bend in said liquid return hose directing a forward portion of said liquid return hose through said closed rear end of said front cylindrical central portion of said tubular housing; and wherein a front end of said liquid return hose is fluidly coupled to a bottom side of said secondary reservoir.

13. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump;

a secondary reservoir coupled to said tubular housing wherein said secondary reservoir collects excess fluid from said nozzle;

a release rod extending downwardly through a top side of a front cylindrical central portion of said tubular housing; and wherein said release rod extends downwardly through a top side of said secondary reservoir.

14. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump; and a secondary reservoir coupled to said tubular housing wherein said secondary reservoir collects excess fluid from said nozzle; and a nipple coupled a bottom end of said release rod wherein said nipple is positioned within a front end of a liquid return hose wherein said nipple closes said front end of said liquid return hose.

15. A bubble blowing assembly for blowing bubbles with manually pumped air, said assembly comprising:

a tubular housing configured to be gripped by a user;

a pump operationally coupled to said tubular housing wherein said pump is configured to be pumped by the user wherein said pump urges air into said tubular housing;

a primary reservoir operationally coupled to said tubular housing wherein said primary reservoir is configured to contain a fluid;

a nozzle operationally coupled to said tubular housing;

a fluid hose operationally coupled between said tubular housing and said primary reservoir wherein said fluid hose selectively directs the fluid into said nozzle;

a first air hose operationally coupled between said tubular housing and said nozzle wherein said first air hose directs the pumped air into said nozzle wherein said nozzle generates the bubbles when the user pumps said pump; and a secondary reservoir coupled to said tubular housing wherein said secondary reservoir collects excess fluid from said nozzle; and said release rod being selectively urged upwardly wherein a nipple is removed from a front end of a liquid return hose wherein the liquid in a secondary reservoir travels through said liquid return hose into said primary reservoir.

16. A bubble blowing assembly for blowing bubbles with manually pumped air, said assembly comprising:

a tubular housing configured to be gripped by a user, said tubular housing comprising;

an open front end of a semi-hemispherical rear portion of said tubular housing being removably coupled to an open rear end of a cylindrical central portion of said tubular housing;

an open rear end of a semi-hemispherical front portion of said tubular housing being removably coupled to a closed front end of said cylindrical central portion of said tubular housing;

said cylindrical central portion of said tubular housing being one of a pair of said cylindrical central portions of said tubular housing;

an open front end of a rear one of said pair of cylindrical central portions of said tubular housing being coupled to a closed rear end of a front one of said pair of cylindrical central portions of said tubular housing wherein an interior of said rear cylindrical central portion of said tubular housing is discrete from an interior of said front cylindrical central portion of said tubular housing;

a first air pipe aperture extending through a rear end of said semi-hemispherical rear portion of said tubular housing;

a first end of an air pipe extending through said first air aperture wherein said air pipe is in fluid communication with an interior of said rear cylindrical central portion of said tubular housing;

a pump elongated along a longitudinal axis extending through a front end and a back end of said pump wherein said pump has a hollow cylindrical shape;

a second air pipe aperture extending through said front end of said pump;

said air pipe extending through said second air pipe aperture wherein said pump is slidably coupled to said air pipe wherein said air pipe is in fluid communication with an interior of said pump, said pump being selectively urged toward and away from said tubular housing along said air pipe wherein said pump urges air into an interior of said rear cylindrical central portion of said tubular housing;

a primary reservoir elongated along a longitudinal axis extending through an open top end and a closed bottom end of said primary reservoir wherein said primary reservoir has a hollow cylindrical shape wherein said primary reservoir is configured to contain a fluid, an outer surface of said open top end of said primary reservoir threadably engaging an inner surface of a nipple extending downwardly from a bottom side of said rear cylindrical central portion of said tubular housing wherein said primary reservoir is selectively retained on said rear cylindrical central portion of said tubular housing;

a channel extending into a front side of said semi-hemispherical front portion of said tubular housing wherein said channel extends between a top side and a bottom side of said semi-hemispherical front portion of said tubular housing;

a nozzle operationally coupled to said tubular housing, an outer wall of said nozzle being curved wherein said nozzle has an ovoid shape, a hollow front portion of said nozzle being coupled to a solid rear portion of said nozzle, a rear side of said outer wall of said nozzle being coupled to a back wall of said channel wherein said hollow front portion of said nozzle is directed forwardly from said semi-hemispherical front portion of said tubular housing;

a bubble opening extending through a front side of said hollow front portion of said nozzle;

a film coupled to said hollow front portion of said nozzle wherein said film covers said bubble opening;

a lower portion of a fluid hose extending downwardly through said nipple wherein a bottom end of said fluid hose is positioned proximate said closed bottom end of said primary reservoir, a pig tail portion of said fluid hose directing an upper portion of said fluid hose forwardly through each of said closed rear end and said closed front end of said front cylindrical center portion of said tubular housing and said solid rear portion of said nozzle wherein a front end of said fluid hose is positioned within an interior of said hollow front portion of said nozzle;

a first air hose extending through each of said closed rear end and said closed front end of said front cylindrical center portion of said tubular housing and said solid rear portion of said nozzle wherein a front end of said first air hose is positioned within an interior of said hollow front portion of said nozzle, a rear end of said first air hose being positioned within an interior of said rear cylindrical center portion of said tubular housing, said pump selectively urging air through said first air hose wherein the air is delivered into said hollow front portion of said nozzle;

a second air hose coupled to said tubular housing, a first end of said second air hose being positioned within an interior of said rear cylindrical center portion of said tubular housing, a central bend on said second air hose directing a second end of said second air hose downwardly into said nipple wherein primary reservoir is in fluid communication with an interior of said rear cylindrical central portion of said tubular housing, said pump selectively urging air into said primary reservoir wherein the fluid in said primary reservoir is urged upwardly through said fluid hose wherein the fluid is delivered into a hollow front portion of said nozzle wherein said nozzle generates the bubbles when a user moves said pump;

a secondary reservoir coupled to said tubular housing wherein a rear end of said secondary reservoir is positioned within an interior of said front cylindrical center portion of said tubular housing, said secondary reservoir extending forwardly through said back wall of said channel wherein a front end of said secondary reservoir is positioned beneath said nozzle;

an opening extending through a top side of said secondary reservoir proximate said front end of said secondary reservoir wherein said opening is positioned below a drain in said nozzle wherein said secondary reservoir receives excess fluid from said drain;

a liquid return hose coupled to said tubular housing, a lower portion of said liquid return hose extending downwardly through said nipple wherein a bottom end of said liquid return hose is positioned proximate said closed bottom end of said primary reservoir, a central bend in said liquid return hose directing a forward portion of said liquid return hose through said closed rear end of said front cylindrical central portion of said tubular housing, a front end of said liquid return hose being fluidly coupled to a bottom side of said secondary reservoir;

a release rod extending downwardly through a top side of said front cylindrical central portion of said tubular housing, said release rod extending downwardly through a top side of said secondary reservoir;

a nipple coupled a bottom end of said release rod wherein said nipple is positioned within said front end of said liquid return hose wherein said nipple closes said front end of said liquid return hose; and said release rod being selectively urged upwardly wherein said nipple is removed from said front end of said liquid return hose wherein the liquid in said secondary reservoir travels through said liquid return hose into said primary reservoir.

* * * * *